US008342072B2

(12) United States Patent
Abbott

(10) Patent No.: US 8,342,072 B2
(45) Date of Patent: Jan. 1, 2013

(54) LINKAGE FOR RIMMED AMMUNITION

(75) Inventor: Brian F. Abbott, Salem, OR (US)

(73) Assignee: Magpul Industries Corp., Boulder, CO (US)

( * ) Notice: Subject to any disclaimer, the term of this patent is extended or adjusted under 35 U.S.C. 154(b) by 0 days.

(21) Appl. No.: 13/176,693

(22) Filed: Jul. 5, 2011

(65) Prior Publication Data

US 2012/0000351 A1 Jan. 5, 2012

Related U.S. Application Data

(60) Provisional application No. 61/361,000, filed on Jul. 2, 2010.

(51) Int. Cl.
*F41A 9/29* (2006.01)

(52) U.S. Cl. ..... 89/33.2

(58) Field of Classification Search ..... 33/35.01, 33/35.02, 33.2, 33.14, 33.25, 33.16
See application file for complete search history.

(56) References Cited

U.S. PATENT DOCUMENTS

| | | | | | |
|---|---|---|---|---|---|
| 1,038,078 | A | * | 9/1912 | Bjorgum | 89/35.01 |
| 2,173,837 | A | * | 9/1939 | Gorton | 89/35.02 |
| 2,401,050 | A | * | 5/1946 | Cooper et al. | 89/35.02 |
| 2,426,448 | A | * | 8/1947 | Goldfisher | 89/35.02 |
| 2,480,950 | A | * | 9/1949 | Murphy | 89/35.02 |
| 2,648,258 | A | * | 8/1953 | Simpson | 89/33.25 |
| 2,733,640 | A | * | 2/1956 | Gilligan | 89/35.02 |
| 3,596,557 | A | * | 8/1971 | Henshaw | 89/33.2 |
| 3,650,176 | A | * | 3/1972 | Lindner | 89/35.02 |
| 4,290,339 | A | * | 9/1981 | Skahill | 89/33.25 |
| 4,586,423 | A | * | 5/1986 | Stauffacher | 89/35.02 |

* cited by examiner

*Primary Examiner* — Bret Hayes
*Assistant Examiner* — Reginald Tillman, Jr.
(74) *Attorney, Agent, or Firm* — Geoffrey E. Dobbin; Dobbin IP Law, P.C.

(57) ABSTRACT

A linking system for rimmed ammunition is disclosed. The linking system features individual links that each encompass one ammunition cartridge while having an arcuate lateral arm which encompasses a neighboring link and associated cartridge. A plurality of collet arms secure the cartridge and separate as the cartridge is forced forward in the delinking process. Angular momenta from the feeding motion and the rotational motion of the de-linking assembly combine to rotate a first link away and apart from the next associated link.

8 Claims, 6 Drawing Sheets

FIG. 11
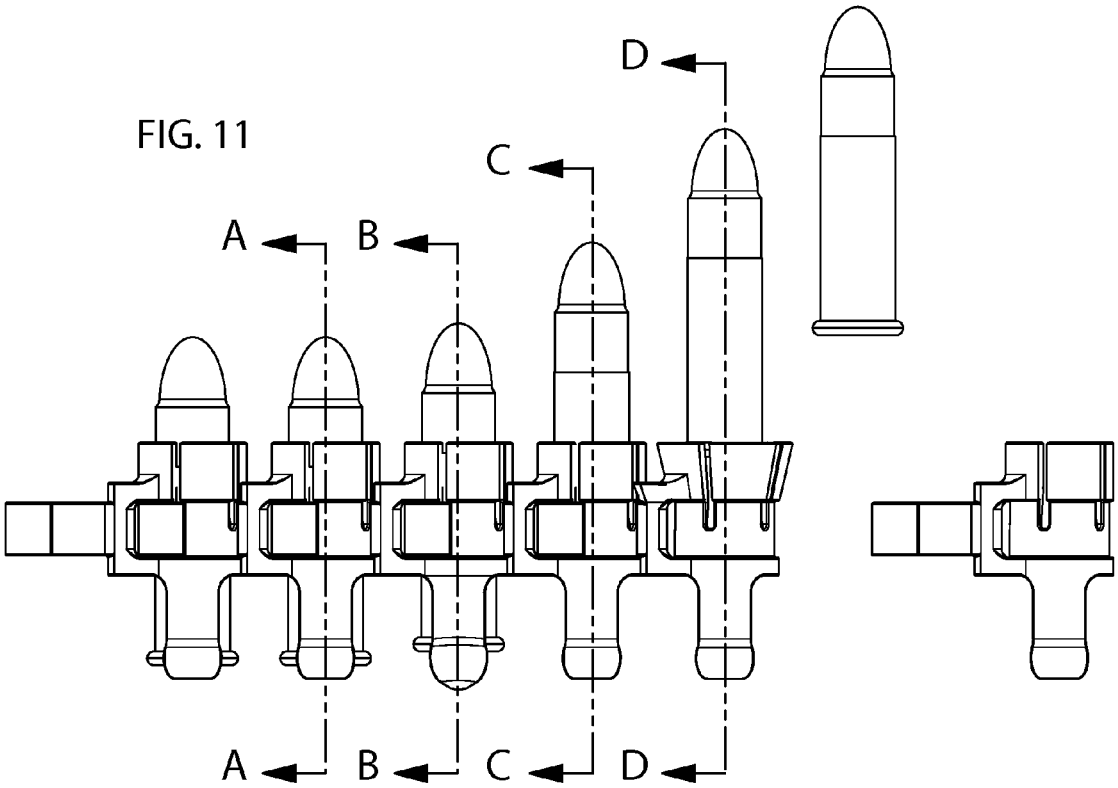
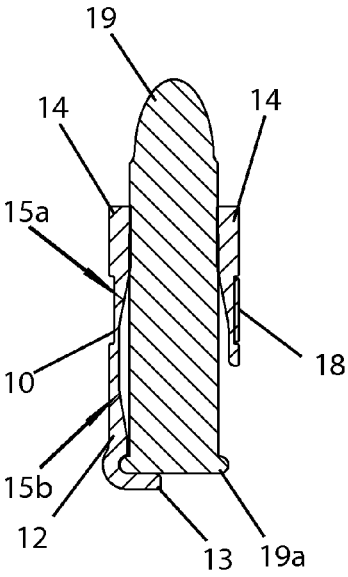
FIG. 12
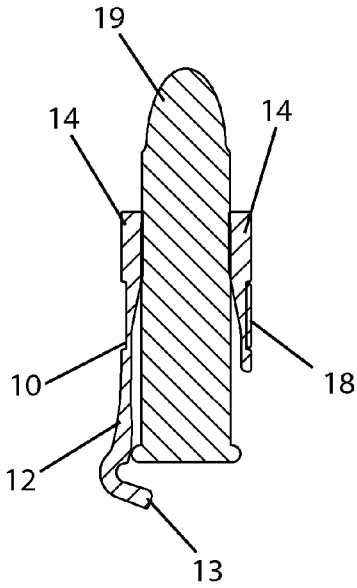
FIG. 13
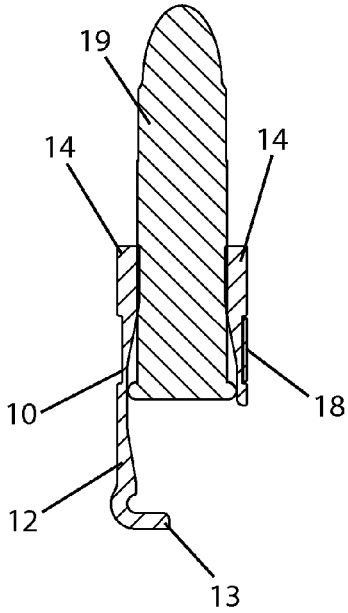
FIG. 14

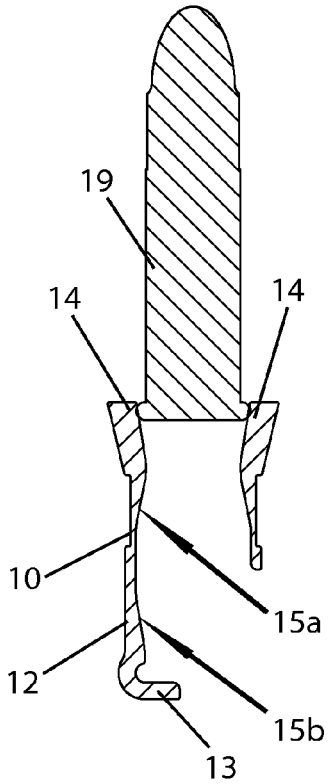
FIG. 15
FIG. 16
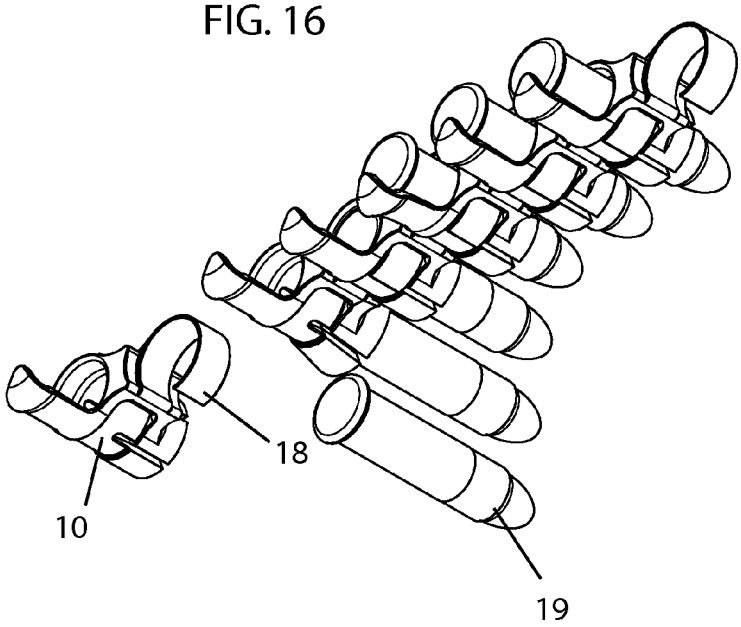
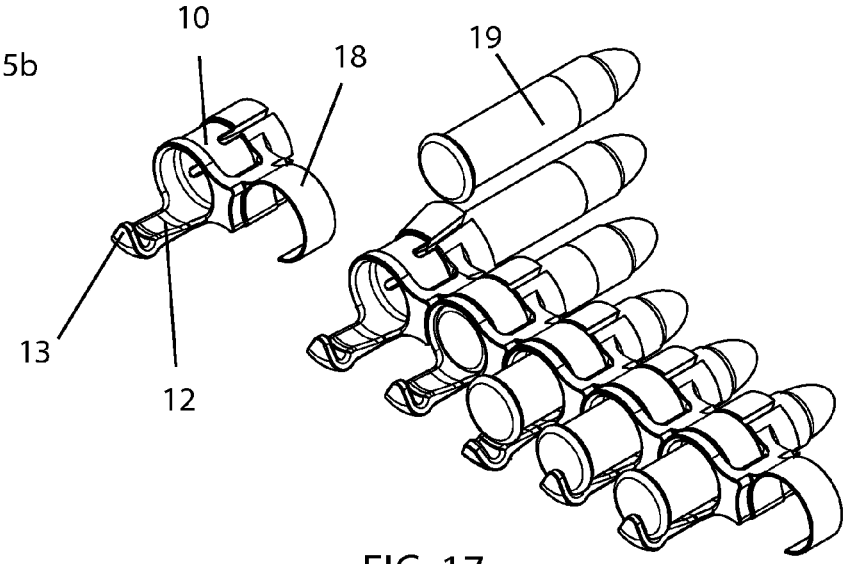
FIG. 17

LINKAGE FOR RIMMED AMMUNITION

CROSS-REFERENCES TO RELATED APPLICATIONS

This Application claims priority based on U.S. Provisional Application Ser. No. 61/361,000, filed Jul. 2, 2010 and incorporates the same in its entirety by reference herein.

FIELD OF THE INVENTION

The present invention relates to the field of firearms and more particularly relates to a linkage structure for rimmed ammunition and a push-through de-linking system for separating ammunition linked with the linkage structure.

BACKGROUND OF THE INVENTION

Linked ammunition is commonly used in machine guns where ammunition is chain fed into the weapon, de-linked and fired. However, rimmed ammunition, where the bottom rim extends beyond the circumference of the cartridge jacket, has notoriously been difficult to link, and there is no effective structure that links these rimmed cartridges in a push-through feeding system. In linked ammunition systems, the linkages typically rely on adjacent ammunition cartridges to hold the links together.

The present invention is a linking system that links flare rimmed cartridges together and allows them to be de-linked in a push-through manner, which is to say that each cartridge is contained in a discrete, individual link and pushed through that link as the cartridge is chambered. As the cartridge is pushed through the link, the link is disconnected from the next link in the chain and discarded. Links utilized in this linking system may utilize at least one, or more, arms that partially wrap around adjacent ammunition cartridges in order to secure the links in a chain.

The present invention represents a departure from the prior art in that the linkage system of the present invention allows for ammunition to be pushed through and out of the individual links of the system. An improved firearm is also provided to remove and chamber ammunition.

SUMMARY OF THE INVENTION

In view of the foregoing disadvantages inherent in the known types of linking systems for rimmed ammunition, this invention provides a more efficient linkage system for rimmed ammunition cartridges and also a delinking system for removing and chambering the ammunition. As such, the present invention's general purpose is to provide a new and improved linkage system that is easy to assemble and manipulate and also easily deployed and features easy removal of ammunition from the individual links.

To accomplish these objectives, the link, in its preferred embodiment, comprises a cylindrical collar for holding a cartridge of ammunition. The cylindrical collar is fringed on one end with a plurality of collet arms. The interior of the cylindrical collar is sloped to facilitate opening of the collet arms when the ammunition is pushed therethrough. A spacer is to one side of the cylindrical collar and a connection arm extends therefrom. The connection arm is sized to wrap around the cylindrical collar of an adjacent link and slide through an orifice in the spacer, thereby connecting the links together.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 11 is a bottom plan view of a series of links of FIG. 1, assembled and loaded with ammunition, in varying stages of deployment.

FIG. 12 is a sectional view of a link and associated ammunition taken along line A-A of FIG. 11.

FIG. 13 is a sectional view of a link and associated ammunition taken along line B-B of FIG. 11.

FIG. 14 is a sectional view of a link and associated ammunition taken along line C-C of FIG. 11.

FIG. 15 is a sectional view of a link and associated ammunition taken along line D-D of FIG. 11.

FIG. 16 is a bottom perspective view of the series of links of FIG. 11.

FIG. 17 is a top perspective view of the series of links of FIG. 11.

DETAILED DESCRIPTION OF THE PREFERRED EMBODIMENT

Figure 1:
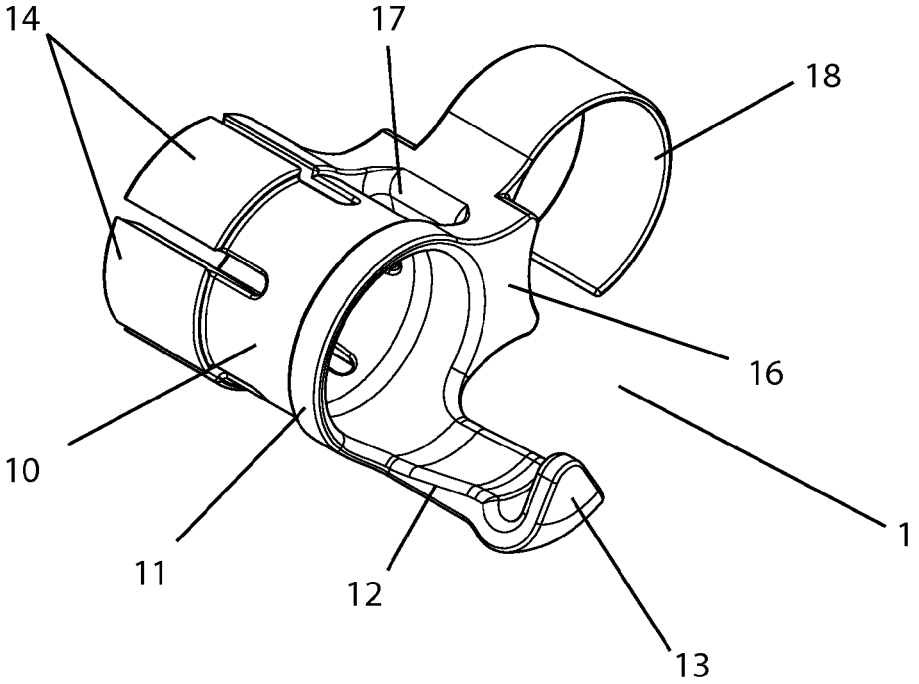
FIG. 1 is a left/rear perspective view of a link made according to one embodiment of the present invention.
Figure 2:
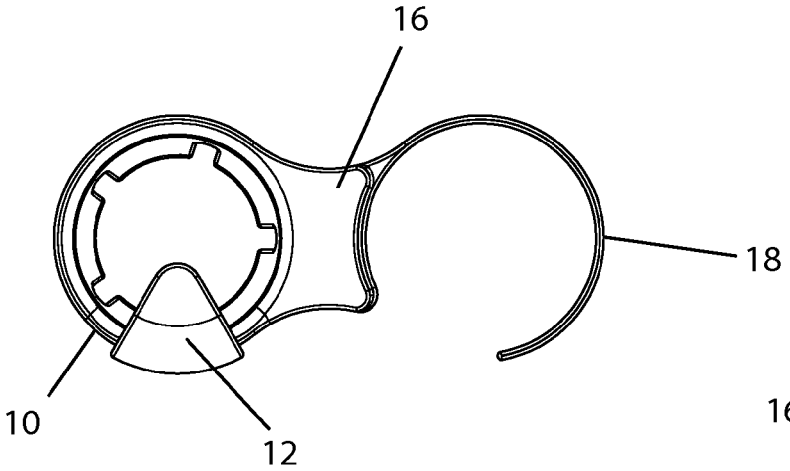
FIG. 2 is a rear elevation of the link of FIG. 1
Figure 3:
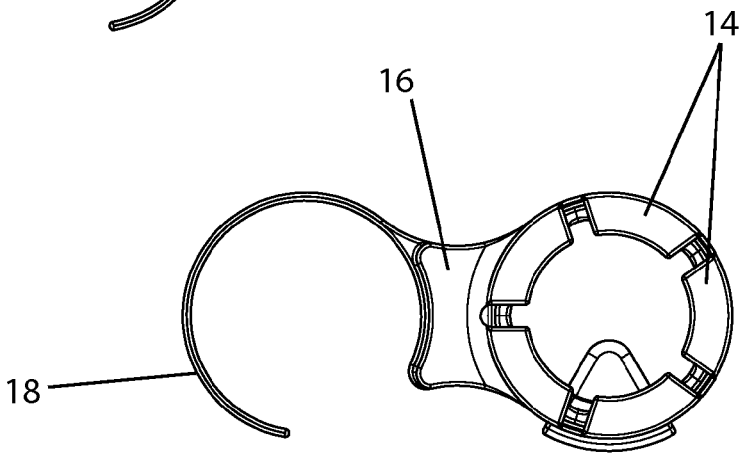
FIG. 3 is a front elevation of the link of FIG. 1.
Figure 4:
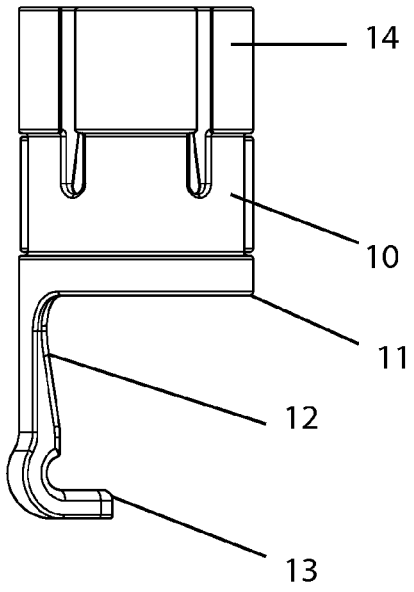
FIG. 4 is a left elevation of the link of FIG. 1.
Figure 7:
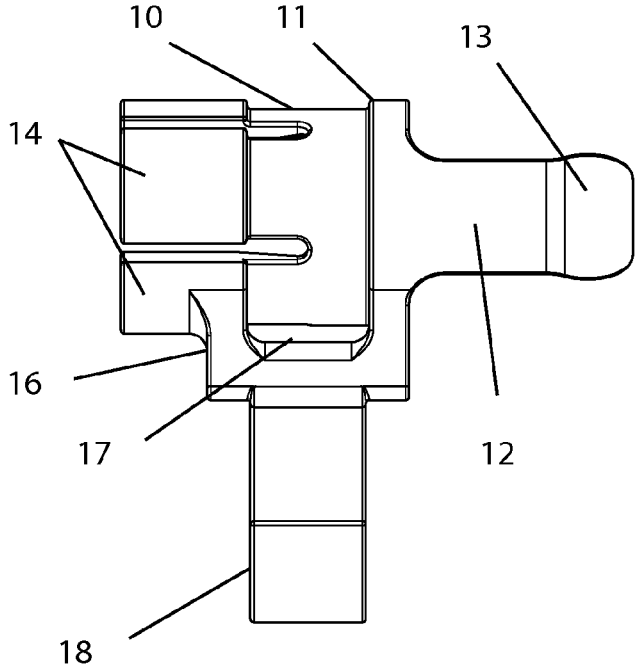
FIG. 7 is a bottom plan view of the link of FIG. 1.
Figure 5:
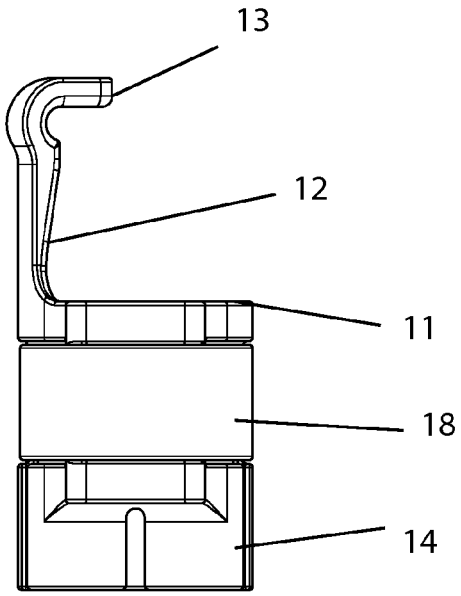
FIG. 5 is a right elevation of the link of FIG. 1.
Figure 6:
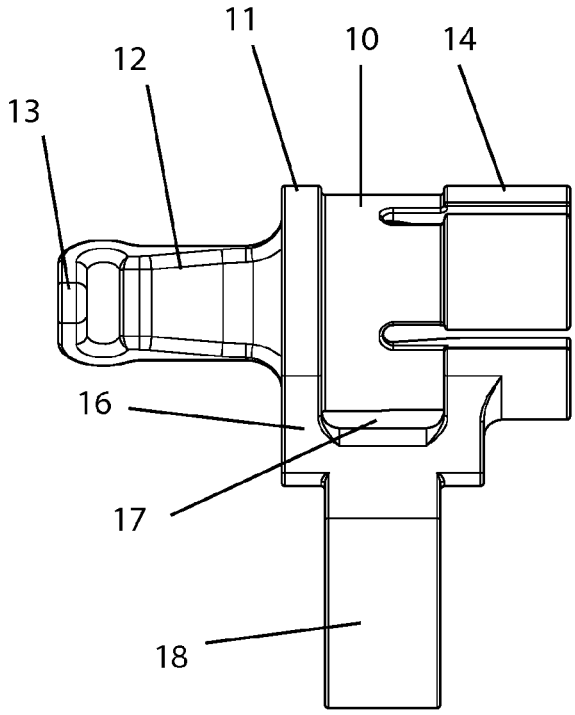
FIG. 6 is a top plan view of the link of FIG. 1.
Figure 8:
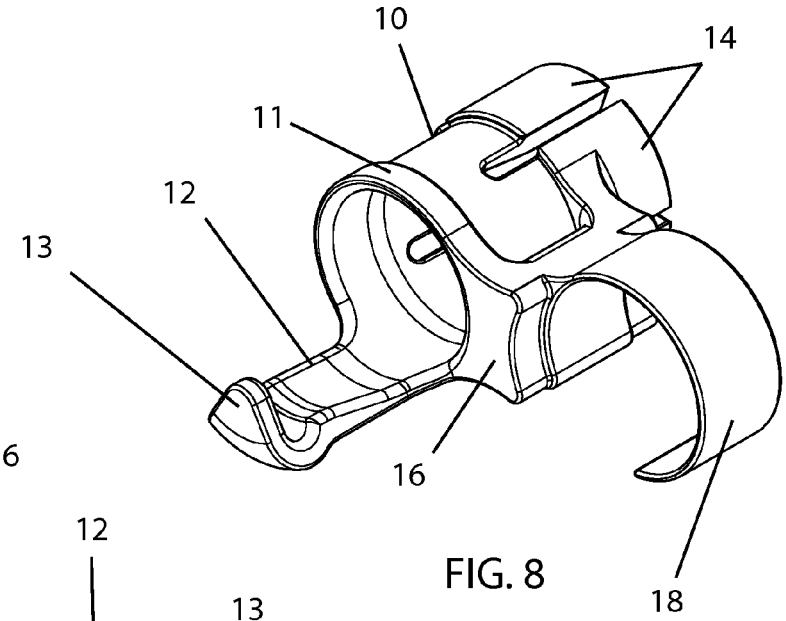
FIG. 8 is a right/rear perspective view of the link of FIG. 1.
Figure 9:
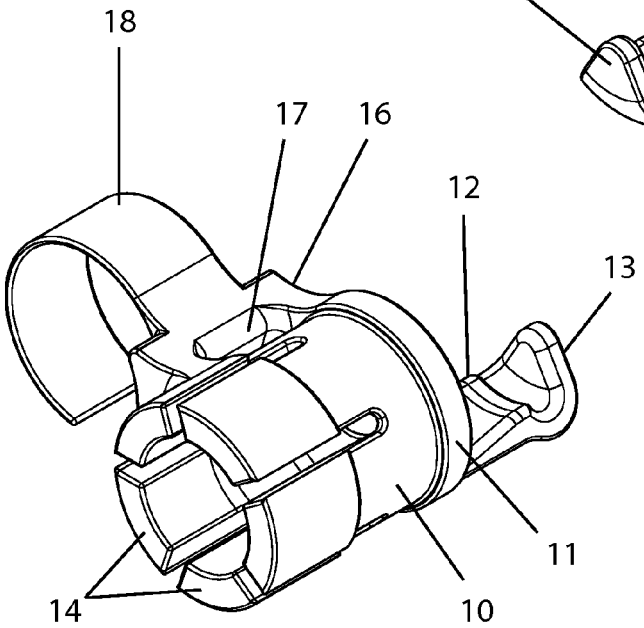
FIG. 9 is a top/front perspective view of the link of FIG. 1.
Figure 10:
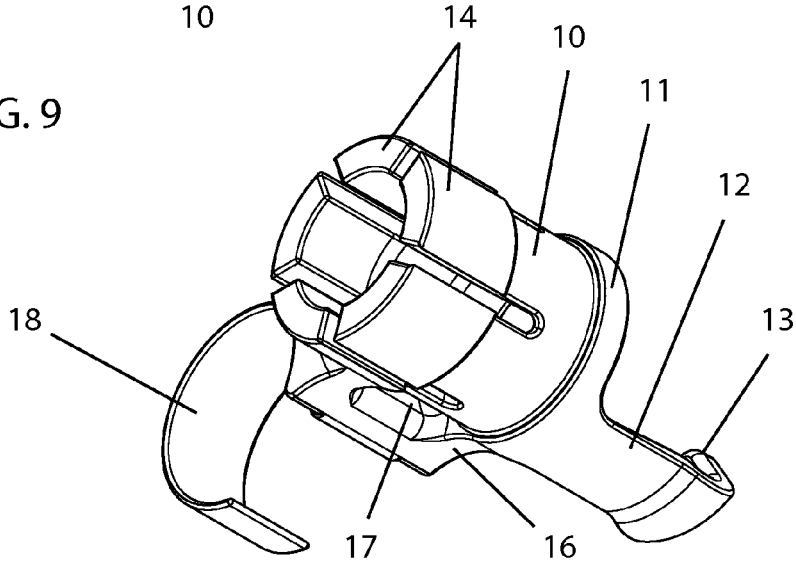
FIG. 10 is a bottom/front perspective view of the link of FIG. 1.

With reference now to the drawings, the preferred embodiment of the linkage assembly and the associate delinking apparatus is herein described. It should be noted that the articles "a", "an", and "the", as used in this specification, include plural referents unless the content clearly dictates otherwise.

With reference to FIGS. 1-17 a preferred embodiment of the link 1 is described. In the preferred embodiment, the basic link structure 1 is a cylindrical collar 10 sized to encompass a cartridge of ammunition of a given type. A first, securement, arm 12 extends from a rim 11 of the cylindrical collar 10 and terminates in a clip 13. This first arm aids in securing the link 1 to the cartridge of ammunition 19 by clipping onto the rim 19*a* of the cartridge. A spacer 16 projects from a side of the cylindrical collar 10 and a second, linking, arm 18 projects therefrom. The linking arm 18 is arcuate and wraps around a cylindrical collar 10 of an adjacent link, as shown in FIGS. 16 and 17, and thereby secures them together. Linking arm 18 slides into slot 17 present between the spacer 16 and cylindrical collar 10. It should be noted that while one linking arm 18 is shown, the use of multiple arms is possible.

A plurality of collet arms 14 extend from an edge of the cylindrical collar 10 opposite the rim 11. Four such arms are depicted in the preferred embodiment, though any number two or more may be used. The collet arms 14 grasp the ammunition cartridge when it is therein installed. The collet arms 14 are generally thicker than the cylindrical collar 10 as is rim 11. Together rim 11 cylindrical collar 10, and collet arms 14 define a trench in which linking arm 18 of an adjacent link may reside. The thickness of linking arm 18 and cylindrical collar 10 together should not exceed that of collet arms 14 or the rim 11. It should also be noted that the division of the collet arms 14 originates in the defined trench.

With reference to FIGS. 11-15, the interior wall of the cylindrical collar 10 tapers from the collet arms 14 and the rim 11. This tapering forms two interior slopes, 15*a* and 15*b*. The tapered interior wall, which is directly underneath the trench, is then thinner than the remainder of the cylindrical collar 10 and the collet arms 14 and has greater ability to flex, thus facilitating the removal of the clip 13 from the ammunition cartridge (FIG. 13) and the travel of the cartridge through the cylindrical collar 10 (FIG. 14). As the cartridge 19 travels through the link, it splays the collet arms 14 (FIG. 15) and is thereby released. This splaying is directly attributable to the flexibility of the cylindrical collar's wall.

It should be noted that both the trench and the tapering 15 of the interior wall of the cylindrical collar 10 decrease the overall thickness of the cylindrical collar's wall which, in turn, facilitates the flexing of the collet arms 14 and the securement arm 12 in order to allow removal of the cartridge. Ideally, both features should be present. However, the presence of one as opposed to the other will also serve to make the cylindrical collar's wall thinner and provide the necessary flex.

Figure 18:
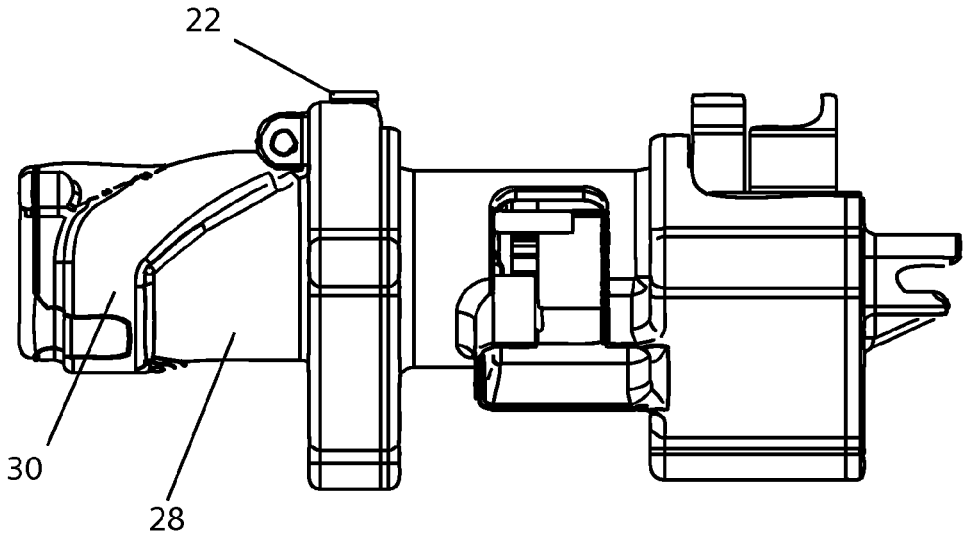
FIG. 18 (prior art)
FIG. 18 is a side elevation of a prior art delinking assembly
Figure 19:
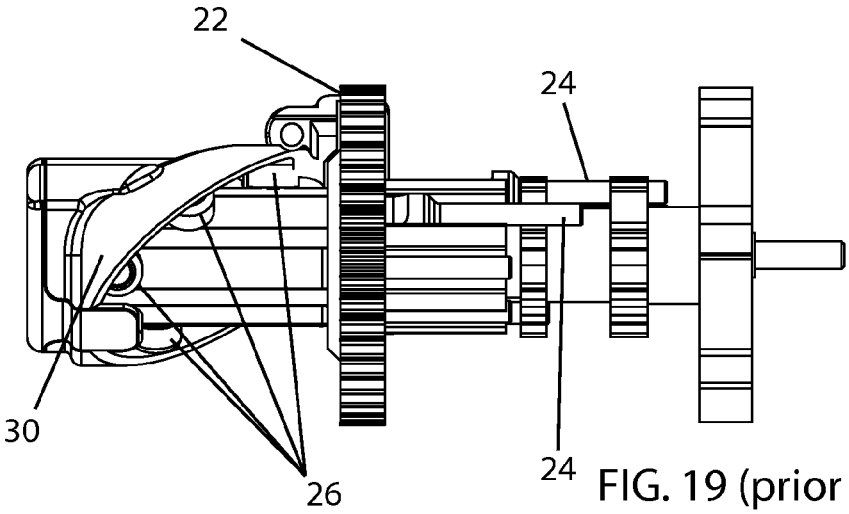
FIG. 19 (prior art)
FIG. 19 is a partial cut-away view of the de-linking assembly of FIG. 18.
Figure 20:
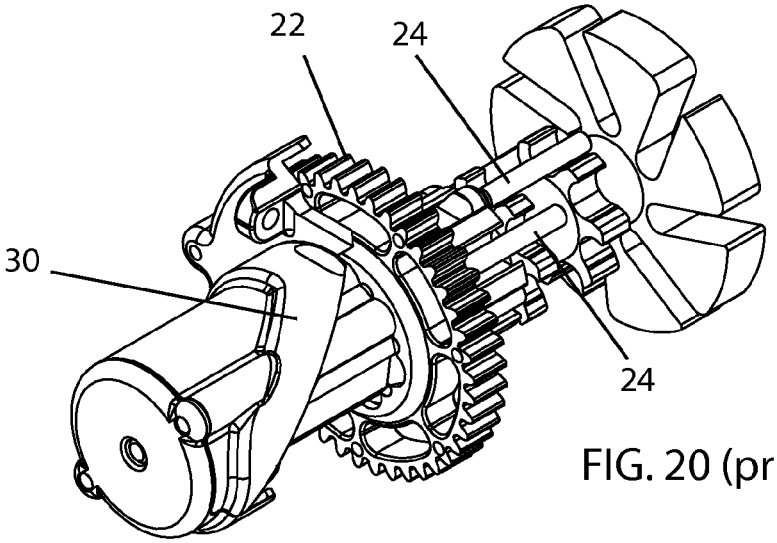
FIG. 20 (prior art)
FIG. 20 is a perspective view of the de-linking assembly of FIG. 19.

A public domain de-linking assembly 20 is shown in FIGS. 18-20 and provided to provide background into the environment and method in which the link works. The assembly shown is driven by a gear 22 that is in communication with the firearm mechanism. Inside the delinking assembly 20 are a plurality of pistons 24, each with an engagement structure 26. They are encased in a housing 28 with an internal track 30 in which the engagement structure 26 of each piston rests within the internal track 30. As the gear 22 rotates, the pistons 24 also rotate and the engagement structure 26 of each piston 24 follows the internal track 30. The track 30 is specifically shaped to cyclically guide the pistons 24 forward to push the ammunition from the links, as described above, and then rearward. Together, the angular momenta of the de-linking assembly and of the ammunition as it is fed into the system serve to rotate the links relative to each other. This rotation serves to slide the linking arm 18 of a first link out of the slot 17 of an adjacent link, thereby uncoupling the first link from the link adjacent to it.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An ammunition link for rimmed cartridges comprising:

a. A cylindrical collar, said cylindrical collar having two edges and an interior wall that is tapered towards a middle of said interior wall from both edges;

b. A securement arm extending from one edge of the cylindrical collar and terminating in a clip suitable for attaching to a rim of an ammunition cartridge;

c. A spacer located along an exterior wall of the cylindrical collar such that a space is defined between the exterior wall of the cylinder and the spacer;

d. An arcuate linking arm, projecting from the spacer, laterally in relation to the cylindrical collar; and e. A plurality of collet arms projecting from the edge of the cylindrical collar opposite the securement arm.

2. The ammunition link of claim 1, further comprising the collet arms and edge of the link opposite therefrom both having a greater thickness than the wall of the cylindrical collar.

3. The ammunition link of claim 2, further comprising a trench located and positioned to receive a linking arm of a second link, said trench being located above the tapered portion of the interior wall of the cylindrical collar.

4. The ammunition link of claim 1, further comprising a trench located and positioned to receive a linking arm of a second link.

5. A plurality of linked ammunition cartridges, each cartridge contained within a discrete link structure, each link structure further comprising:

a. A cylindrical collar, said cylindrical collar having two edges and an interior wall that is tapered towards a middle of said interior wall from both edges;

b. A securement arm extending from one edge of the cylindrical collar and terminating in a clip suitable for attaching to a rim of an ammunition cartridge;

c. A spacer located along an exterior wall of the cylindrical collar such that a space is defined between the exterior wall of the cylinder and the spacer;

d. An arcuate linking arm, projecting from the spacer, laterally in relation to the cylindrical collar; and e. A plurality of collet arms projecting from the edge of the cylindrical collar opposite the securement arm.

6. The plurality of linked ammunition cartridges of claim 5, each link structure further comprising the collet arms and edge of the link opposite therefrom both having a greater thickness than the wall of the cylindrical collar.

7. The plurality of linked ammunition cartridges of claim 6, each link structure further comprising a trench located and positioned to receive a linking arm of a second link, said trench being located above the tapered portion of the interior wall of the cylindrical collar.

8. The plurality of linked ammunition cartridges of claim 5, each link structure further comprising a trench located and positioned to receive a linking arm of a second link.

* * * * *